United States Patent [19]

Donchev et al.

[11] Patent Number: 4,909,144

[45] Date of Patent: Mar. 20, 1990

[54] DOCTOR FOR FLAT SCREEN PRINTING MACHINE

[75] Inventors: Anton N. Donchev; Georgi N. Yordanov; Georgi B. Damyanov, all of Sofia; Dechko H. Merdjanov, Samokov, all of Bulgaria

[73] Assignee: TK "Samokovska Komuna", Samokov, Bulgaria

[21] Appl. No.: 272,558

[22] Filed: Nov. 16, 1988

[51] Int. Cl.[4] ..... B05C 1/06; B41L 13/18

[52] U.S. Cl. ..... 101/123; 101/120

[58] Field of Search ..... 101/119, 120, 123, 124, 101/167, 169, 335; 118/256, 261; 15/256.5, 256.51; 401/261, 266

[56] References Cited

U.S. PATENT DOCUMENTS 4,061,001 12/1977 Eltz et al. ..... 68/200
4,498,318 2/1985 Mitter ..... 68/200

FOREIGN PATENT DOCUMENTS 681379 9/1939 Fed. Rep. of Germany .
1268094 5/1968 Fed. Rep. of Germany ..... 101/119
2114174 10/1972 Fed. Rep. of Germany ..... 101/119
2346825 3/1975 Fed. Rep. of Germany ..... 101/119
2523062 12/1976 Fed. Rep. of Germany .
3150936 6/1983 Fed. Rep. of Germany .

*Primary Examiner*—Edgar S. Burr
*Assistant Examiner*—Ren Yan
*Attorney, Agent, or Firm*—Herbert Dubno

[57] ABSTRACT

A doctor for a flat screen printing machine, shaped as an elongated vessel with variable cross-section along its length, is symmetrical to the vertical axis Z. The height of the vessel is greatest at the point of the Z axis, where there are attached to it a flexible hose for supply of printing paste and a flexible hose for air draw-off. The cross-section of the doctor is an isosceles trapezium, turned with its smaller base towards the flat screen. On this base there is fastened a T-shaped lug onto which there is mounted a U-shaped applying profile made of friction material. In the center of the small base of the trapezium, the T-shaped lug and the U-shaped applying profile there is shaped along the length of the vessel a metering slot. At the metering slot there is disposed a valve mechanism which consists of a T-shaped section having a length greater than that of the metering slot, and to the vertical arm of this section there are attached hingedly the piston rods of two pneumatic cylinders, which are symmetrically disposed to the Z axis. The horizontal arm of the T-shaped section is directed towards the metering slot and is provided with a seal.

2 Claims, 2 Drawing Sheets

DOCTOR FOR FLAT SCREEN PRINTING MACHINE

FIELD OF THE INVENTION

Our present invention relates to a doctor for a flat screen printing machine intended for the printing of voluminous textile materials, such as blankets, wool cloth, thick cotton fabrics, using foamed and ordinary printing pastes.

BACKGROUND OF THE INVENTION

A known flat screen printing machine (Otdelka i Krashenie sherstyannyh tkanei. Handbook edited by V. L. Molokov. Moscow, Legprombytizdat, 1985, 264 p.) which has two flat doctors comprises an endless rubberized conveyor, a flat screen, a doctor unit and a frame. The flat screen is fastened rigidly to the frame, and the doctors are disposed laterally to the endless rubberized conveyor. To the frame there is mounted the doctor unit. This doctor unit consists of two pairs of mechanisms for two-sided attachment of both flat doctors and for regulating their angle and pressure on the flat screen.

A drawback of the flat doctors lies in that they cannot be used with foamed printing pastes, since the foamed paste, analogous to the ordinary paste, is in free state between the doctors on the screen where, as a result of the continuous mechanical action of both flat doctors, the paste is further foamed or broken down. This results in a change of the properties of the foam and in an abrupt worsening of the print. Another drawback is that the feeding with printing paste is manual, and can detrimentally affect worker hygiene. There appear frequently faults on the textile materials because of the spread of paste over their surface, particularly in the printing of blankets with low-viscosity printing pastes. Because of the poor penetration of the paste in the printing of bulky cloth, a repeated doctoring is necessary and can in a reduction of the output of the machine.

OBJECT OF THE INVENTION

It is therefore a general object of this invention to provide a doctor for a flat screen printing machine which makes possible the mechanization of the process of feeding and printing paste, an improvement in the conditions of labor and a reduction of the faults of printing.

SUMMARY OF THE INVENTION

This object is achieved by a doctor for a flat screen printing machine, shaped as an elongated vessel with a variable cross-section along its length, symmetrical with respect to the vertical axis Z. The height of the vessel is the greatest at the immediate vicinity of the axis Z, where there are attached to it a flexible hose for supply of printing paste and a flexible hose for air draw-off. The cross-section of the doctor is an isosceles trapezium, turned with its smaller base towards the flat screen. To this base there is fastened a T-shaped lug onto which there is mounted a U-shaped applying profile made of a friction material.

In the center of the small basis of the trapezium, the T-shaped lug and the U-shaped applying profile, there is shaped along the length of the vessel a metering slot. In the metering slot there is disposed a valve mechanism. This valve mechanism consists of a T-shaped section having a length greater than that of the metering slot and, to the vertical arm of this section, there are attached hingedly the piston rods of two pneumatic cylinders, which are symmetrically disposed with respect to the axis Z. The horizontal arm of the T-shaped section is directed towards the metering slot and is provided with a seal.

An advantages of the invention is that it makes possible the printing not only with ordinary pastes, but also with foamed printing paste and, at that, the latter is in an isolated state in the doctor and does not change its properties during the motion of the doctor. This provides for a high-quality print and eliminates totally the faults due to the spread of the paste over the bulky textile material. The design of the doctor makes possible the mechanized feeding of printing paste and, as a result of this, the conditions of labor are improved. In a single doctoring there is achieved a good penetration of the paste and the necessity of repeated doctoring is eliminated, thus increasing the output of the machine.

BRIEF DESCRIPTION OF THE DRAWINGS

The above and other objects, features and advantages of my invention will become more readily apparent from the following description, reference being made to the accompanying highly diagrammatic drawing in which.

SPECIFIC DESCRIPTION

Figure 1:
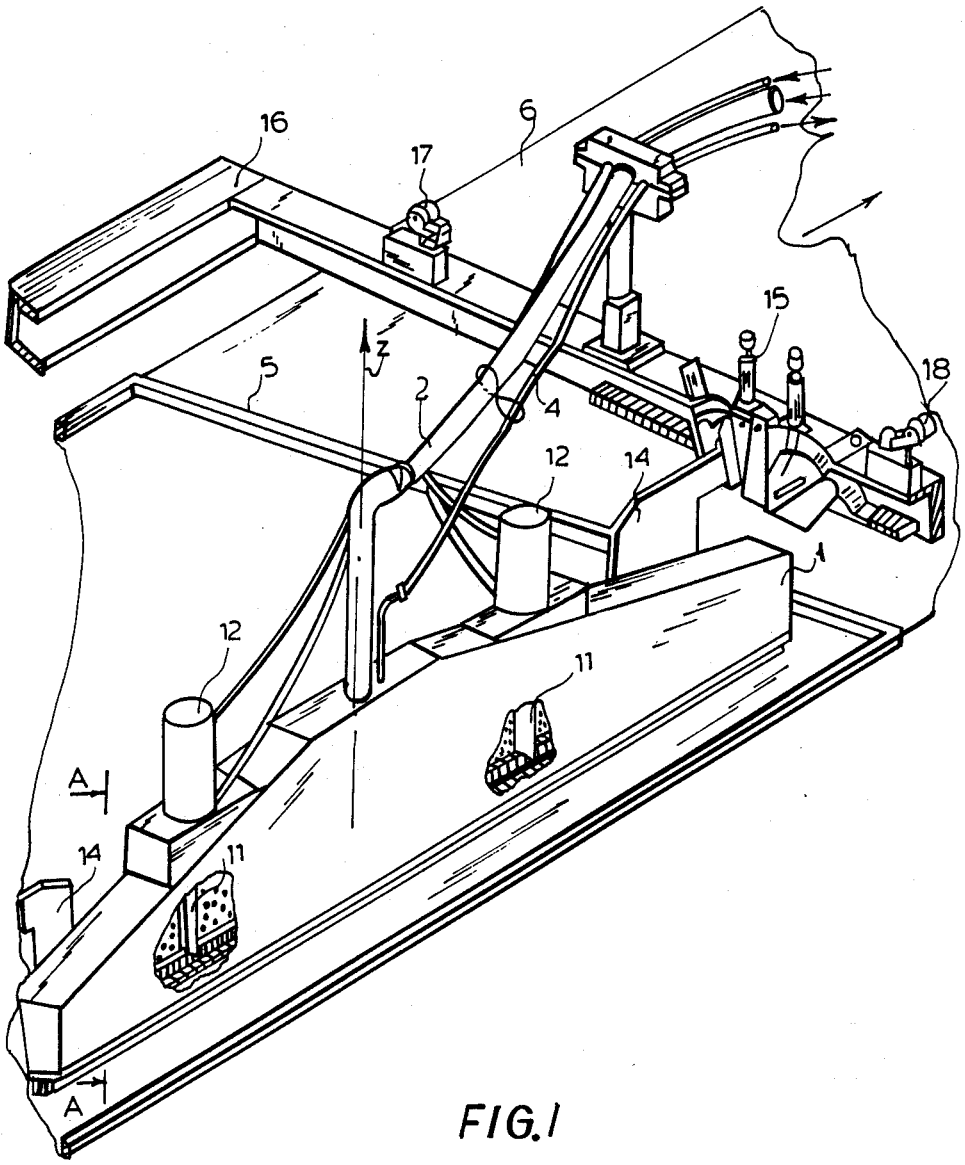
FIG. 1 is a perspective view of the doctor for printing with foamed and ordinary printing pastes on a flat screen printing machine.
Figure 2:
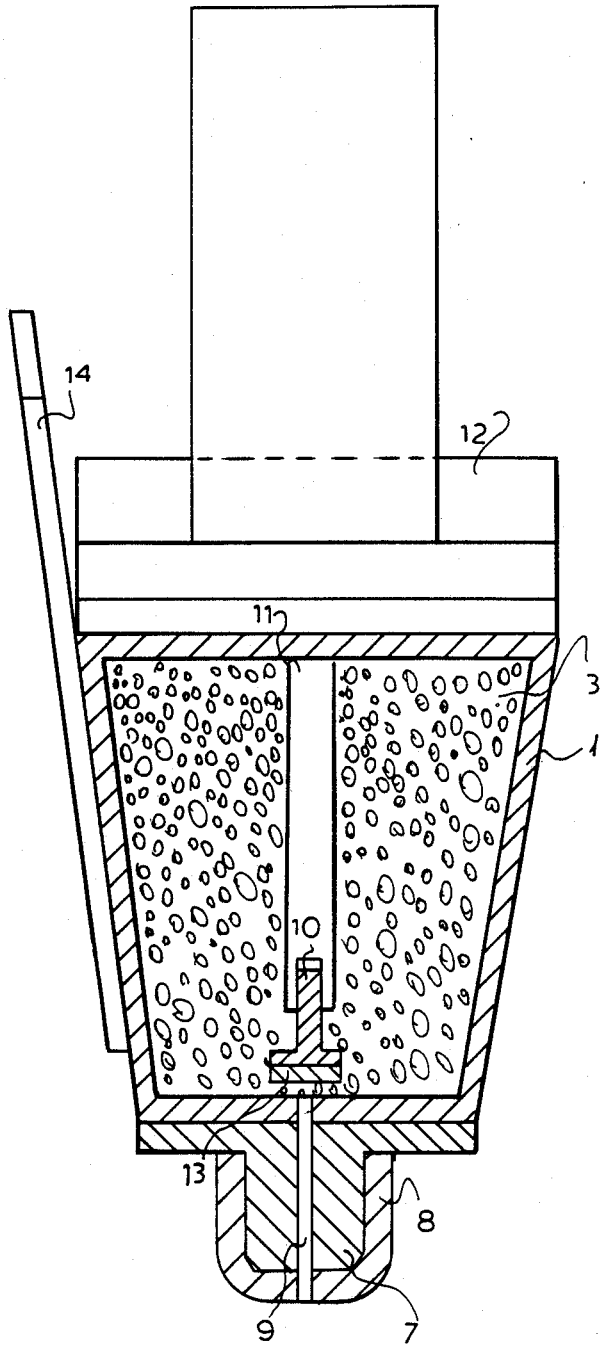
FIG. 2 is a sectional view taken along A—A in FIG. 1.

The doctor for printing with foamed and ordinary printing pastes on a flat screen printing machine is shaped as an elongated vessel 1 with a variable cross-section along its length, and in symmetrical with respect to the vertical axis Z.

The height of the vessel 1 is greatest at the region of the axis Z where there are attached to it a flexible hose 2 for supply of printing paste 3 and a flexible hose 9 for air draw-off 4.

The cross-section of the elongated vessel 1 is an isosceles trapezium, turned with its smaller base to the flat screen 5 and the endless rubberized conveyor 6.

To the smaller base of the trapezium there is fastened a T-shaped lug 7 onto which there is mounted a U-shaped applying profile 8 made of friction material. In the center of the small base of the trapezium, the T-shaped lug 7 and the U-shaped applying profile 8, there is shaped along the length of the elongated vessel 1 a metering slot 9, onto which there is mounted a valve mechanism. This valve mechanism consists of a T-shaped section 10 having a length greater than that of the metering slot 9. To the vertical arm of the T-shaped section there are attached hingedly the piston rods 11 of two pneumatic cylinders 12 which are disposed symmetrically on both sides of the Z axis.

The horizontal arm of the T-shaped section is directed towards the metering slot 9 and is provided with a seal 13.

The elongated vessel 1 and the valve mechanism are fastened by means of the strips 14 to the doctor unit 15 of the flat screen printing machine which is driving them. In both end positions of the pattern applied on the flat screen 5 there are mounted to the frame 16 two limit switches 17 and 18 which control the valve mechanism.

The operation of the doctor according to the invention is as follows: When the production process begins, the printing paste 3 enters the elongated vessel 1 under pressure via the flexible hose 2 for feeding.

The flexible hose 4 for air draw-off releases continuously the air appearing in the elongated vessel 1. In end stationary position of the doctor, the slot 9 is closed by the valve mechanism.

The elongated vessel 1 is fixed perpendicularly to the flat screen 5 and the endless rubberized conveyor 6 by means of the strips 14 and the doctor unit 15.

After the actuation of the doctor unit 15, the doctor moves in direction of the width of the machine. When the doctor reaches the zone of the pattern on the flat screen 5, the doctor unit 15 releases the limit switch 17. The switch 17 gives a signal for change of the direction of the air pressure inside the pneumatic cylinders 12 which, by means of their piston rods 11, lift the T-shaped section 10 and open the metering slot 9 of the doctor.

In its motion over the surface of the flat screen 5, the doctor prints through its open metering slot 9 the textile material. The penetration of the printing paste 3 through the holes of the flat screen is effected by its pressure in the metering slot 9 of the doctor. At the moment of leaving the opposite zone of the pattern on the flat screen 5 of the doctor, the limit switch 18 is actuated which gives a signal to the pneumatic cylinders 12 for closing the metering slot 9 of the doctor. The doctor, when reaching the end of the flat screen 5, is lifted in closed state together with the screen from the frame 16, then it waits a preset time less rubberized conveyor 6, it descends on the endless rubberized conveyor 6, and the process is repeated. Thus the doctor is synchronized with the operation of the flat screen printing machine and operates in cyclic conditions, printing in both directions.

We claim:

1. A doctor for use with a flat screen printing machine, which comprises an elongated vessel having a vertical axis Z, said vessel having a variable cross-section along its length and being symmetrical with respect to said vertical axis Z, the height of said vessel being greatest at the location of said Z axis; a first flexible hose attached to said vessel at said Z axis for supplying printing paste and a second hose attached to said vessel to draw-off air, the cross-section of said vessel being an isosceles trapezium, turned with its smaller base towards the flat screen and a T-shaped lug fastened to said smaller base and a U-shaped applying profile fastened to said T-shaped lug; said U-shaped applying profile being made of friction material and located in the center of the small base of the trapezium on said T-shaped lug, and an elongated metering slot extending along the length of said elongated vessel; said metering slot extending through said U-shaped profile and said T-shaped lug, and a valve mechanism for controlling flow of printing paste through said slot.

2. A doctor according to claim 1, wherein the valve mechanism consists of a T-shaped section having a vertical and a horizontal arm and having a length greater than that of said metering slot, and pneumatic cylinders having piston rods hingedly attached to the vertical arm of said T-shaped section, the horizontal arm of said T-shaped section being directed towards said metering slot and provided with a seal.

* * * * *